US007717197B2

(12) United States Patent
Wenzel

(10) Patent No.: US 7,717,197 B2
(45) Date of Patent: May 18, 2010

(54) APPARATUS FOR KEEPING A DOWN HOLE DRILLING TOOL VERTICALLY ALIGNED

(76) Inventor: Kenneth H. Wenzel, 150 Kulawy Drive N., Edmonton, AB (CA) T6L 6Y9

( * ) Notice: Subject to any disclaimer, the term of this patent is extended or adjusted under 35 U.S.C. 154(b) by 7 days.

(21) Appl. No.: 12/294,102

(22) PCT Filed: Mar. 16, 2007

(86) PCT No.: PCT/CA2007/000436

§ 371 (c)(1),
(2), (4) Date: Sep. 23, 2008

(87) PCT Pub. No.: WO2007/109878

PCT Pub. Date: Oct. 4, 2007

(65) Prior Publication Data

US 2009/0114451 A1 May 7, 2009

(30) Foreign Application Priority Data

Mar. 24, 2006 (CA) ..... 2541541

(51) Int. Cl.
*E21B 7/00* (2006.01)

(52) U.S. Cl. ..... 175/231; 175/317; 175/325.1

(58) Field of Classification Search ..... 175/231, 175/317, 325.1; 166/241.4
See application file for complete search history.

(56) References Cited

U.S. PATENT DOCUMENTS 3,637,032 A 1/1972 Jeter
4,216,590 A 8/1980 Kelly
4,930,586 A 6/1990 Turin et al.
5,314,030 A 5/1994 Peterson et al.
7,204,325 B2 * 4/2007 Song et al. ..... 175/61

FOREIGN PATENT DOCUMENTS

GB 867025 5/1961

OTHER PUBLICATIONS

Product Brochure for Power V, Schlumberger Marketing Communications, 4 pages, Mar. 2005.
Product Brochure for Vertical Drilling Systems, Baker Hughes Incorporated, Houston, Texas, US, 5 pages, 2004.

* cited by examiner

*Primary Examiner*—William P Neuder
(74) *Attorney, Agent, or Firm*—Davis & Bujold, P.L.L.C.

(57) ABSTRACT

An apparatus (10) for keeping a down hole drilling tool vertically uses a pendulum (36). The pendulum (36) controls flow from outlets (34) of drilling fluid chambers (30), providing drilling fluid to centralizer (24) activating pistons (26) acting upon centralizer blades (24). When the outer housing (12) deviates from a vertical orientation, the pendulum (36) swings by force of gravity to assume an angularly offset pivotal position. This adjusts the hydraulic pressure in one or two of the outlets (34) for one or two of the drilling fluid chambers (30) resulting in a change in the hydraulic force acting upon one or two of the pistons (26) causing one of the centralizers (24) to change their position to urge the outer housing (12) back toward the vertical position until the pendulum (36) again assumes the concentric pivotal position and the balanced pressure equilibrium in the drilling fluid chambers (30) is restored.

10 Claims, 7 Drawing Sheets

APPARATUS FOR KEEPING A DOWN HOLE DRILLING TOOL VERTICALLY ALIGNED

FIELD

The present patent document relates to an apparatus for use in keeping a down hole drilling tool vertically aligned when drilling a vertical well.

BACKGROUND

It is difficult to keep well bores vertically aligned when drilling an oil or gas well. An example of an apparatus that is commercially available to keep a down hole drilling tool vertically aligned when drilling a vertical well is a system known by the Trade Mark "VertiTrak" which is marketed by Baker Hughes Incorporated. Another example of an apparatus that is commercial available to keep a down hole drilling tool vertically aligned when drilling a vertical well is a system know by the Trade Mark "Power V" which is marketed by Schumberger Incorporated.

SUMMARY

Accordingly, there is provided an apparatus for keeping a down hole drilling tool vertically aligned. The apparatus includes a tubular outer housing having a first end, a second end, a longitudinal axis and a circumferential wall that defines an interior bore. Centralizers are provided in spaced relation around the circumferential wall at the second end of the tubular housing. The centralizers are pivotally mounted to the outer housing for pivotal movement between an extended position and a retracted position. Pistons are positioned in piston chambers which are arranged radially in relation to the longitudinal axis. The pistons have an extended position and a retracted position. The pistons underlie each of the centralizers such that, in the extended position the pistons provide a force to urge the centralizers to the extended position. A plurality of discrete drilling fluid chambers are provided. Each of the drilling fluid chambers communicates with one of the piston chambers of one of the pistons. The position of the piston is controlled by a hydraulic pressure in the drilling fluid chamber. Each of the drilling fluid chambers has an inlet through which drilling fluids enter and an outlet. The outlets for the drilling fluid chambers are arranged in an annular configuration. A tubular pendulum is provided that has a circumferential wall, a first end, and a second end. The first end is pivotally secured within the interior bore of the outer housing for omni-directional pivotal movement. The pendulum moves from a concentric pivotal position to an angularly offset pivotal position by force of gravity as the outer housing deviates from a vertical orientation such that, as the pendulum moves between the concentric pivotal position and the angularly offset pivotal position, the pendulum adjusts the hydraulic pressure in at least one drilling fluid chamber by controlling the flow of fluid through the corresponding outlet of the at least one drilling fluid chamber such that, as the hydraulic pressure changes, the piston in communication with the at least one drilling fluid chamber adjusts the position of the centralizers until the outer housing returns to the vertical position.

BRIEF DESCRIPTION OF THE DRAWINGS

These and other features will become more apparent from the following description in which reference is made to the appended drawings, the drawings are for the purpose of illustration only and are not intended to in any way limit the scope to the particular embodiment or embodiments shown, wherein.

DETAILED DESCRIPTION OF THE PREFERRED EMBODIMENT

Figure 1:
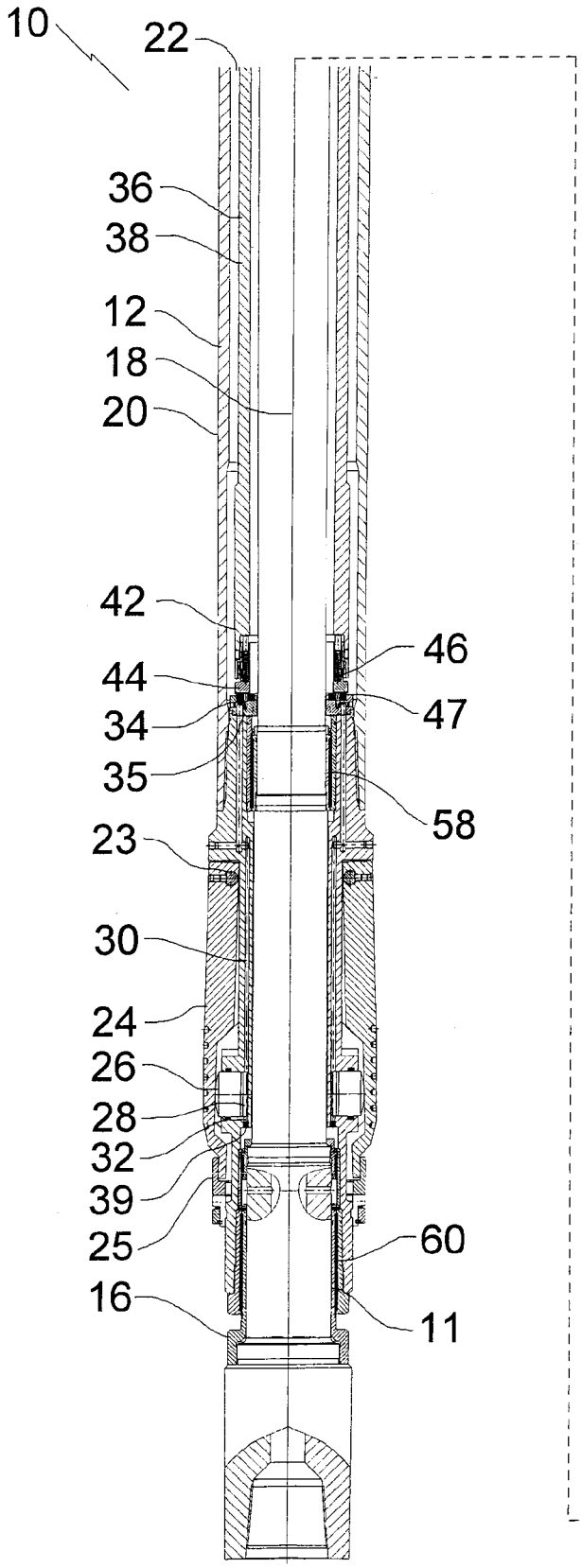
FIG. 1 is a side plan view in section of a lower portion of the apparatus.

The preferred embodiment, an apparatus for keeping a down hole drilling tool vertically aligned generally identified by reference numeral 10, will now be described with reference to FIG. 1 through 5. Alternative embodiments will be described with reference to FIG. 6 through 8.

Figure 2:
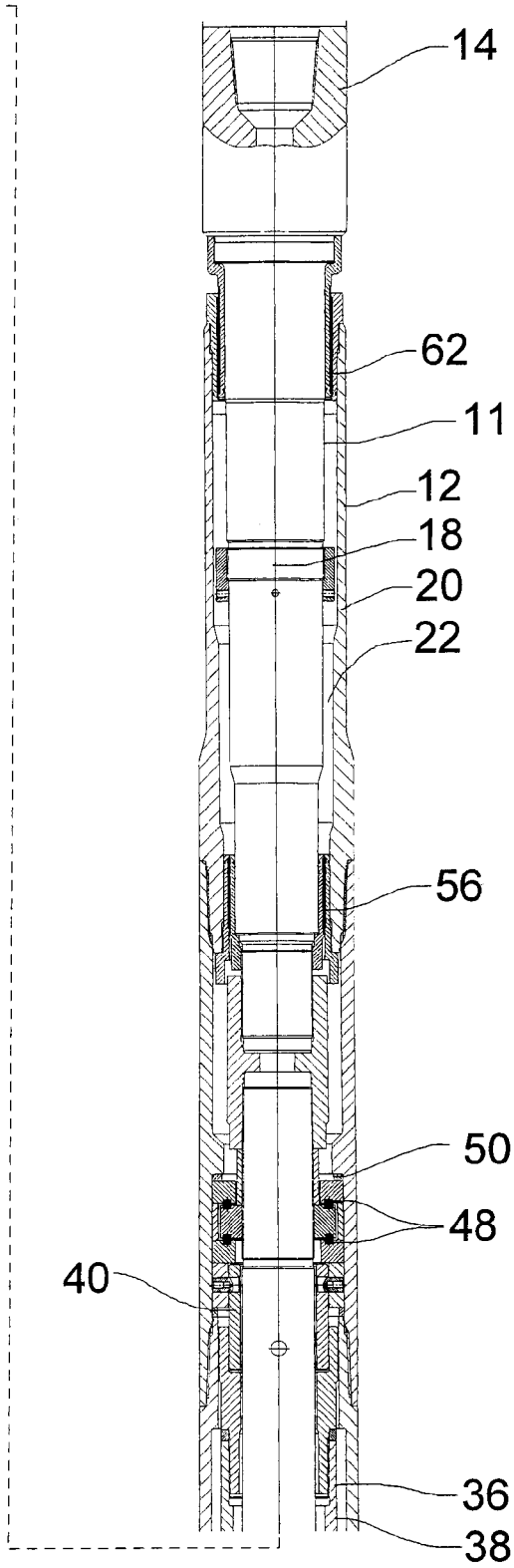
FIG. 2 is a side plan view in section of an upper portion of the apparatus.
Figure 3:
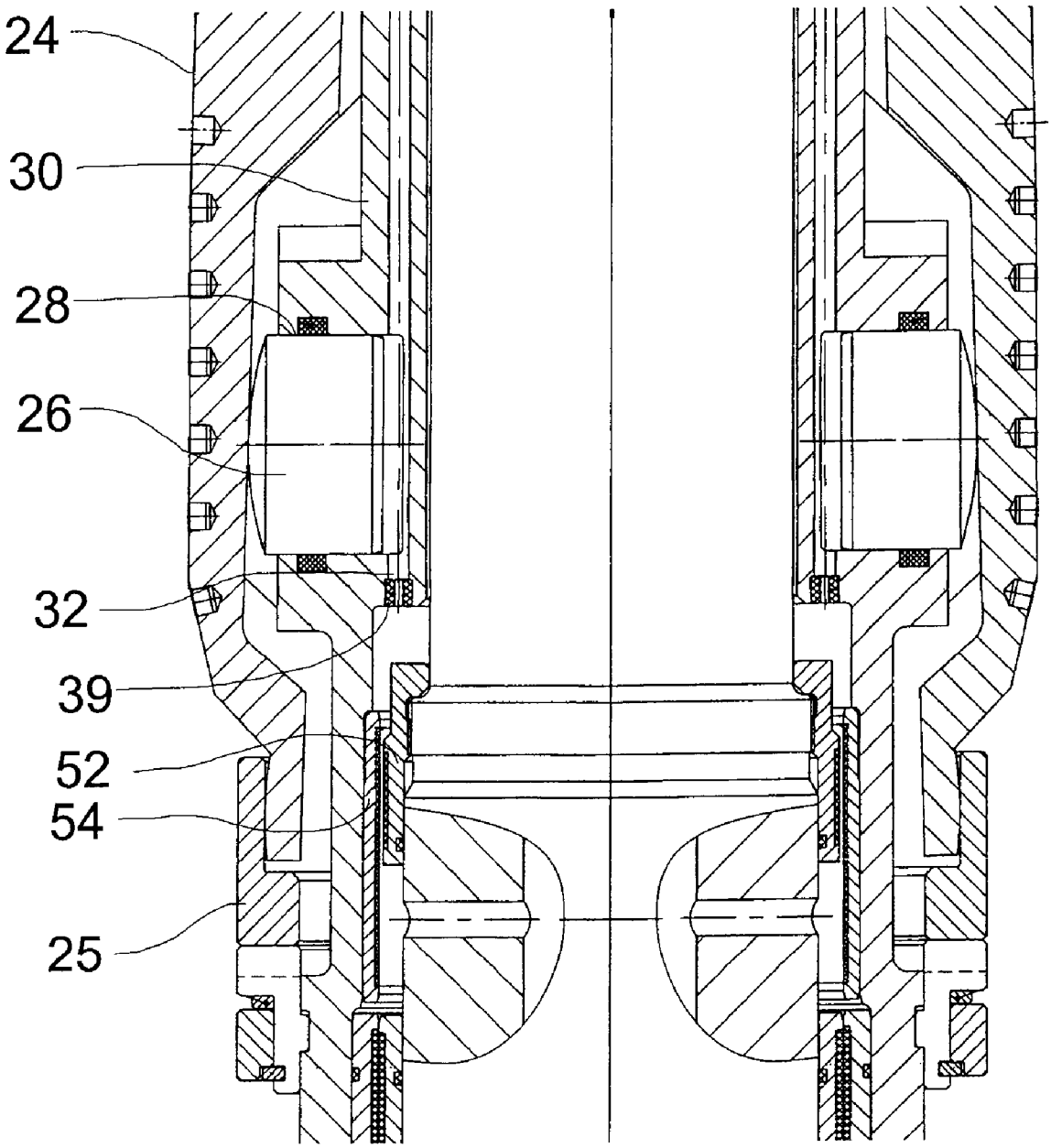
FIG. 3 is a detailed side plan view in section of the piston chamber.
Figure 4:
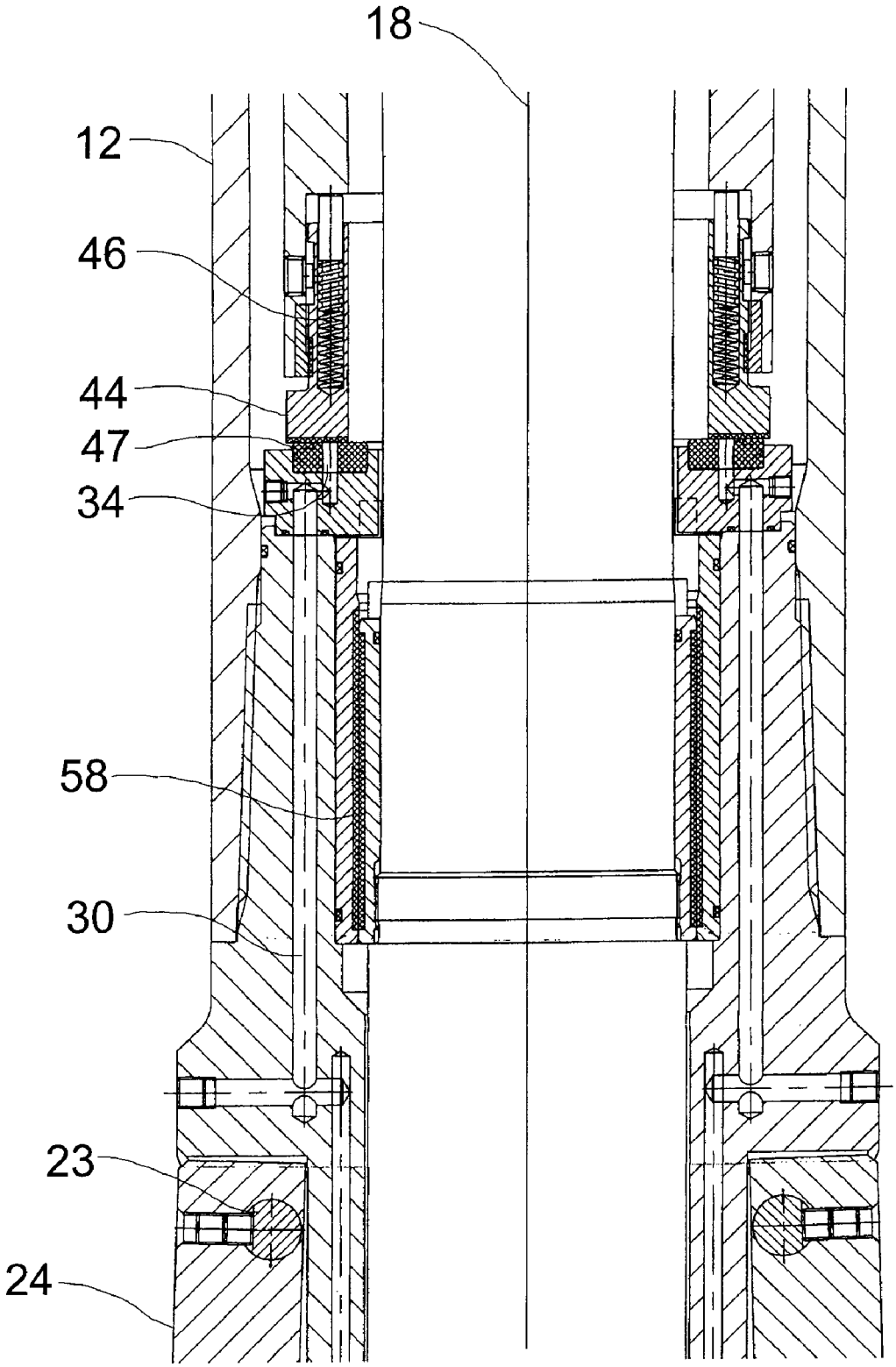
FIG. 4 is a detailed side plan view in section of the fluid chamber outlet.
Figure 5:
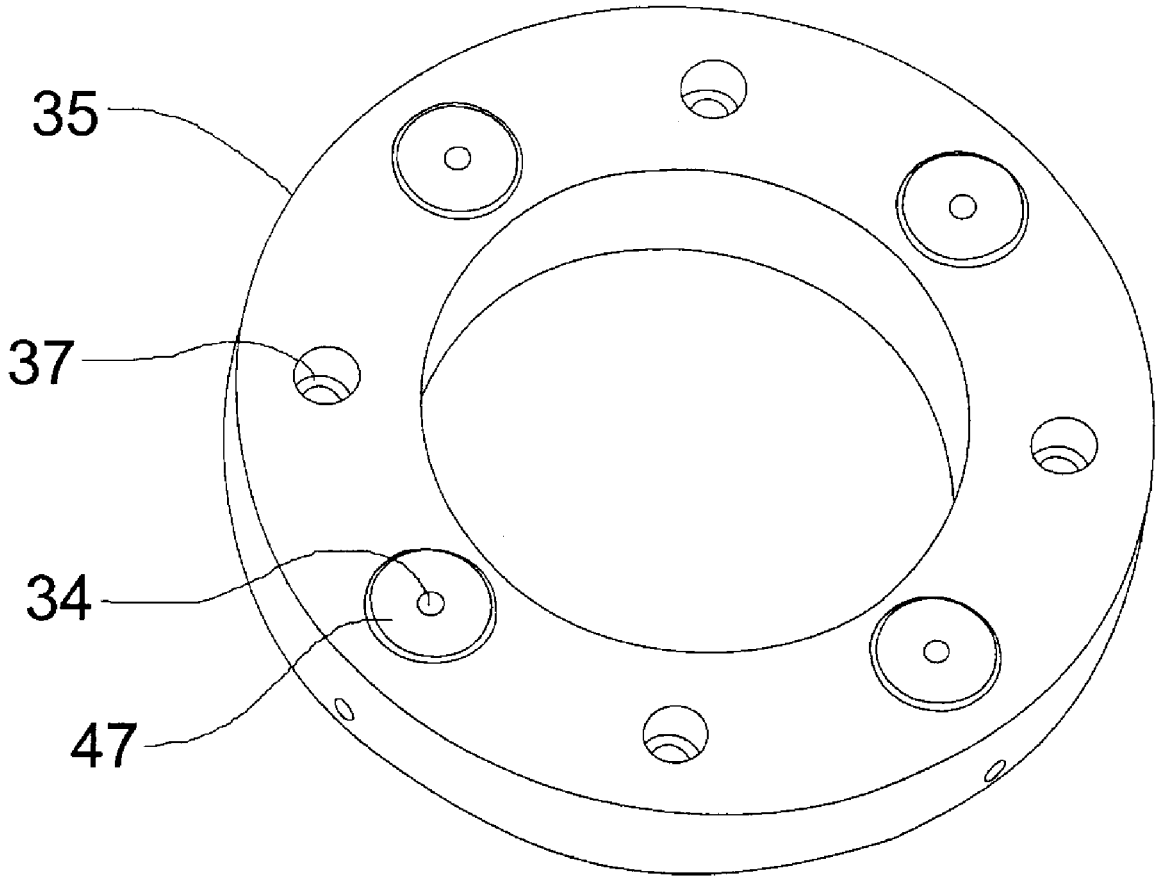
FIG. 5 is a perspective view of the outlet plate.

Structure and Relationship of Parts:

Referring to FIGS. 1 and 2, apparatus for keeping a down hole drilling tool vertically aligned 10 includes a tubular outer housing 12 and an inner mandrel 11. Outer housing has a first end 14, a second end 16, a longitudinal axis 18 and a circumferential wall 20 that defines an interior bore 22. There are centralizers 24 in spaced relation around circumferential wall 20 at second end 16 of tubular housing 12. Centralizers 24 are pivotally mounted at a pivot point 23 to outer housing 12 for pivotal movement between an extended position and a retracted position. Referring to FIG. 3, an annular collar 25 is provided to limit outward movement of centralizers 24 in the extended position. Pistons 26 are positioned in piston chambers 28 and are arranged radially in relation to longitudinal axis 18, where one piston 26 underlies each centralizer 24 and provides a force to urge centralizer 24 to the extended position. There are also a plurality of discrete drilling fluid chambers 30, such that each drilling fluid chamber 30 communicates with a corresponding piston chamber 28, thereby providing hydraulic pressure to maintain piston 26, and therefore centralizer 24, in the extended position. Referring to FIG. 3, each drilling fluid chamber 30 has an inlet 32, through which drilling fluids enter, and, referring to FIG. 4, an outlet 34 extending through outlet plate 35. Referring to FIG. 5, outlet plate 35 is secured using connectors (not shown) through holes 37. Outlets 34 for drilling fluid chamber 30 are also arranged in an annular configuration. Referring to FIG. 3, a flow restrictor 39 is positioned in inlet 32 to drilling fluid chamber 30 to control flow. A pair of concentric metal sleeves 52 and 54 are positioned upstream of inlet 32 to the drilling fluid chamber to grind up large particles in the drilling fluid before they reach the inlet 32. Thus, each centralizer 24 has a corresponding piston chamber 28 with piston 26 and fluid chamber 30 with inlet 32 and outlet 34 positioned radially in a equally spaced manner about housing 12, as are outlets 34 shown in FIG. 5.

Referring to FIGS. 1 and 2, a tubular pendulum 36 is provided within tubular housing 12 that has a circumferential wall 38, a first end 40, and a second end 42. First end 40 is pivotally secured within interior bore 22 of outer housing 12 for omni-directional pivotal movement. These are radial bearings provided both above and below tubular pendulum 36, those bearings, in the form of concentric tungsten carbide sleeves, are upper radial bearings 62, first intermediate radial bearing 56 above tubular pendulum 36, second intermediate radial bearing 58 below tubular pendulum 36 and low radial bearing 60. There are also axial bearings 48 provided at first end 40 to withstand axial forces between inner mandrel 11 and outer housing 12. Optionally, there may be provided biasing springs 50 at first end 40 of pendulum 36 to facilitate axial adjustment during assembly. It has been determined, however, that if care is taken as to the tolerances, springs 50 may be eliminated.

Operation:

Referring to FIG. 1 through 5, apparatus 10 is provided as depicted and described above. Apparatus is preferably attached as a section in a drilling string used for making vertical holes. Mud flows in inlet 32, filling piston chamber 28 and fluid chamber 30, and flows toward outlet 34. When tool positioning places pendulum 36 in the vertical position, or a concentric pivotal position, second end 42 of pendulum 36 is suspended over the annular configuration of outlets 34 such that pendulum 36 substantially blocks each outlet 34 when in the concentric pivotal position to create a flow restriction. This places each drilling fluid chambers 30 in a balanced pressure equilibrium with the others, such that each piston 26 applies an equal force against each corresponding centralizer 24. It is thus important that pistons and centralizers are equally spaced about housing 12, such that in this position, the net force in any one direction is zero. In the preferred embodiment, this is done by using an annular contact member 44 mounted at second end 42 of pendulum 36. Valve seat/bearing surfaces 47 allow annular contact member 44 to slide easily along outlet plate 35. Annular contact member 44 is then biased by biasing springs 46 into engagement with the annular configuration of outlets 34, such that annular contact member 44 closes outlets 34 when pendulum 36 is in the concentric pivotal position. Once the biasing force of biasing springs 46 are overcome, drilling fluids are allowed to bleed past. This is useful to regulate pressure during operation, and also to lubricate valve seat/bearing surfaces 47 so that pendulum 36 tends to hydroplane. Flow restrictor 39 limits the flow rate.

If outer housing 12 deviates from a vertical orientation, pendulum 36 will swing by force of gravity to assume the angularly offset pivotal position (relative to outer housing 12), thereby relieving the flow restriction on one or two of outlets 34 for corresponding drilling fluid chambers 30 and resulting in an increased flow of fluid. This reduces hydraulic force acting upon one or two of pistons 26 and causes the corresponding centralizer 24 to at least partially retract toward the retracted position. The differential pressure from the other centralizers 24 acts to urge outer housing 12 back toward the vertical position until pendulum 26 again assumes the concentric pivotal position and the balanced pressure equilibrium in the drilling fluid chambers is restored. As shown in FIG. 5, there are four outlets 34 illustrated. If pendulum 36 swings directly outwardly from one of outlets 34, that one outlet will be open to fluid flow. However, pendulum 36 will sometimes swing outwardly between two outlets 34, opening those two outlets to fluid flow.

By way of example, operation will be described with apparatus 10 operating in a 12¼ inch hole with 10 pounds per gallon of drilling fluid and the tool oriented in a starting orientation which is a vertical position. Referring to FIG. 4, we will assume a pressure drop across the bit of 750 pounds per square inch (psi) and that springs 46 biasing contact member 44 at second end 42 of pendulum 36 against valve seal/bearing surface 47 and outlet 34, causes pressure in fluid chambers 30 to be maintained at 400 psi. Referring to FIG. 3, this 400 psi. pressure will cause each of the four pistons 26 to expand blades 24 with a force of 3068 pounds, since the cross-sectional area of each piston is 7.67 inches. Retaining ring 25 will restrict blades 24 from expanding more than the diameter of the hole being drilled. Referring to FIG. 4, any pressure above 400 psi. in fluid chambers 30 will cause the contact member 44 at second end 42 to be forced away from valve seat/bearing surface 47 allowing fluid to bleed through outlet 34. The amount of fluid that will pass through the passage provided by drilling fluid chambers 30, will be the amount of drilling fluid that can pass through the four one eighth inch nozzles 34 at a pressure of 350 psi (the difference between the pressure drop across the bit of 750 psi and the back pressure of 400 psi caused by biasing springs 46). At 350 psi and 10 pounds per gallon of drilling fluid, the amount of fluid would be 30 gallons per minute. Referring to FIGS. 1 and 2, this fluid will either exit the tool through a port or through one of the radial bearings positioned above pendulum 36, namely 56 or 62. There will also be additional fluid leakage through the radial bearings positioned below pendulum 36, namely 58 or 60. If apparatus 10 is not vertical, pendulum 36 will swing by force of gravity. Referring to FIG. 4, there will be virtually no resistance to this swinging motion, as contact member 44 at second end 42 of pendulum 36 will hydroplane on the drilling fluid that is leaking through outlet 34. The movement of pendulum 36 will cause one or two of outlets 34 to open. Assuming that one outlet 34 opened, the pressure across flow restrictor 39 at inlet 32 would be 750 psi. Referring to FIG. 3, the flow through drilling fluid chambers 30 is always limited by flow restrictor 39 positioned at inlet 32. As previously described, any large particles in the drilling fluid which might otherwise plug inlet 32 are ground by concentric sleeves 52 and 54.

Advantages:

The VertiTrak and Power V tools are relatively complex and expensive. By comparison, apparatus 10, is simple and is activated by gravity. Apparatus 10 may be used both in circumstances in which the drill string is rotated from the top and in circumstances in which a down hole drilling motor is used. It is, however, important that apparatus 10 be positioned in the drill string with a stabilizer or other stabilizing means above it, so that apparatus 10 is stabilized at its upper end. It is often preferable to rotate the drilling string in order to avoid becoming stuck in the hole. Apparatus 10 is capable of operating even when the drill string is rotated by a down hole drilling motor.

Variations:

The embodiment described above relies upon spring 46 to maintain annular contact member 44 at a sufficient pressure against bearing surface 47, and to block the flow of fluid from annular configuration of outlets 34. It will be understood, however, that other configurations also allow pendulum 36 to adjust the hydraulic pressure in drilling fluid chambers 30 by controlling the flow of fluid through outlets 34 in order to cause centralizers 24 to urge housing 12 back to the vertical position. For example, referring to FIG. 8, instead of having annular contact member 44 block fluid flow from outlets 34 when the tool is vertical as described previously, it may allow fluid to flow when housing 12 is in the vertical position, and block flow from certain outlets 34 when it deviates from the vertical position. In this arrangement, the corresponding pistons 26 would become pressurized and cause the necessary centralizers 24 to move outward in order to urge housing 12 back to the vertical orientation while the other centralizers 24 remain in the retracted position. A possible drawback with this variation is that there will be more friction to the sliding action of the pendulum 24. The reason for this is that fluid bypasses the pendulum 24 and does not hydraulically lift the pendulum 24 as is the case with the embodiment described previously. There will be greater fluid flow through the tool, as the fluid passageways are only blocked when the pendulum goes off centre, however the amount of fluid loss is not considered to be of particular importance.

Figure 6:
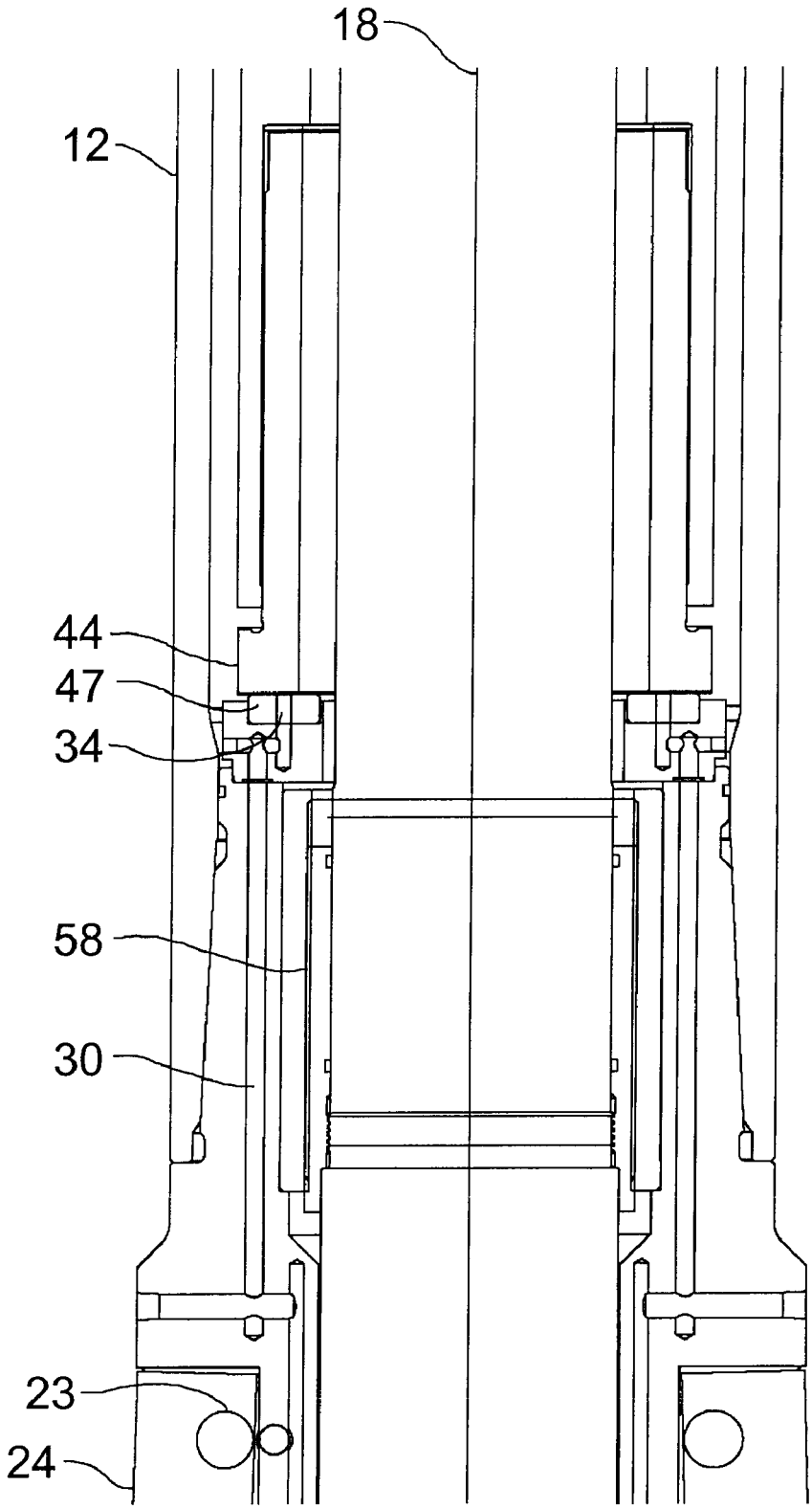
FIG. 6 is a detailed side plan view in section of an alternative of the fluid chamber outlet.
Figure 7:
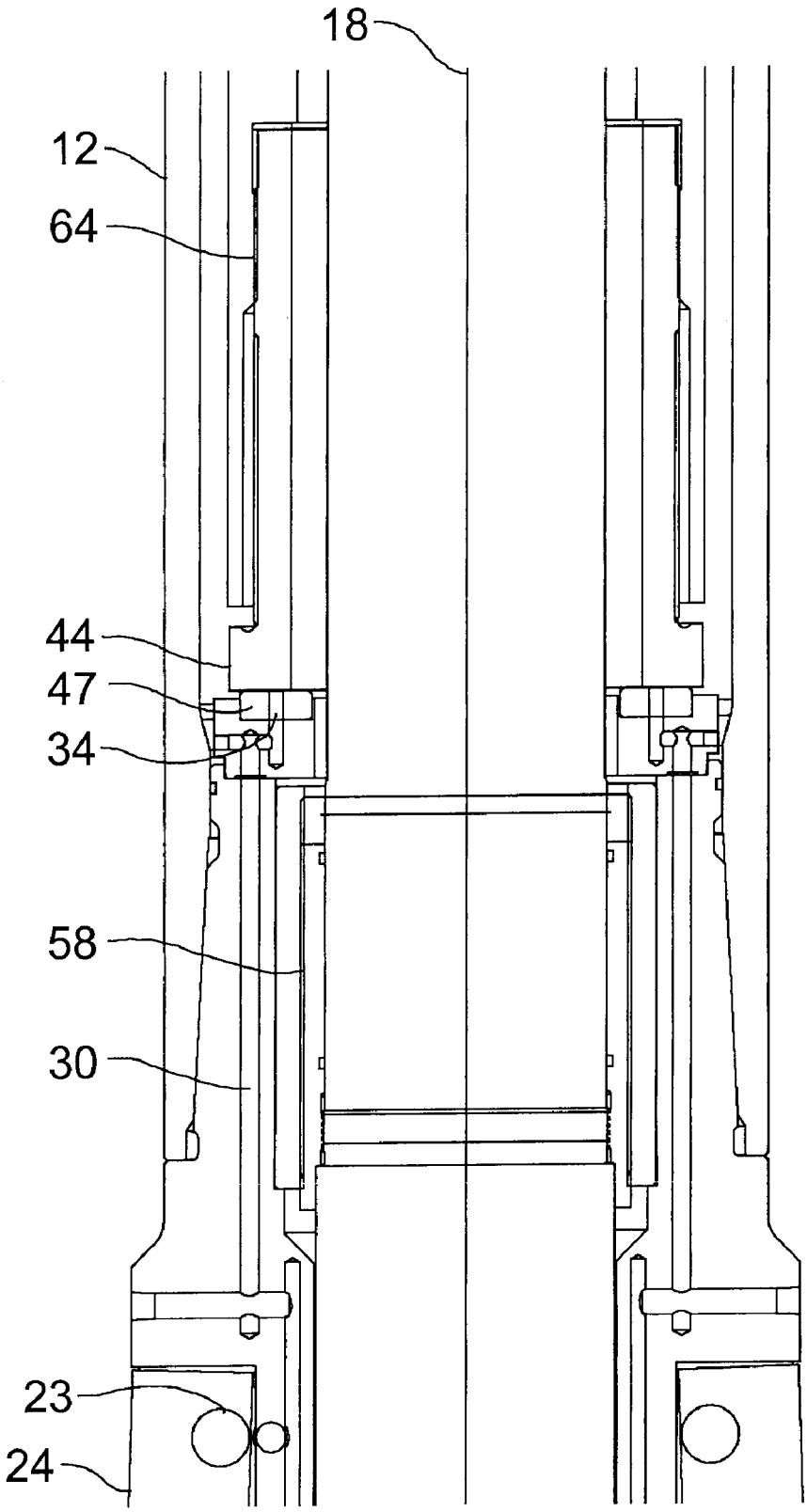
FIG. 7 is a detailed side plan view in section of a further alternative of the fluid chamber outlet.
Figure 8:
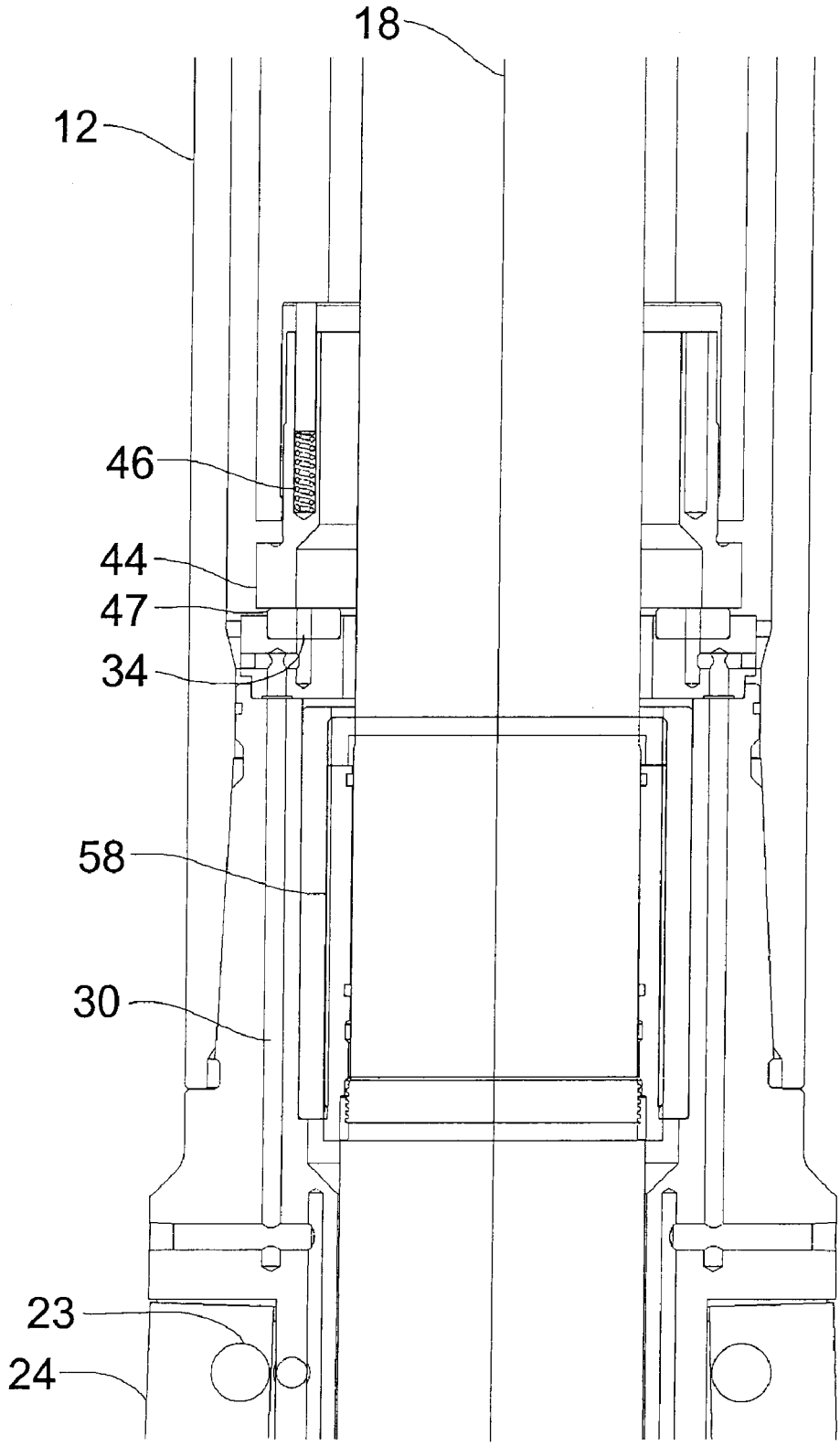
FIG. 8 is a detailed side plan view in section of a further alternative of the fluid chamber outlet.

Other alternatives also exist to maintain contact between annular contact member 44 and bearing surface 47. Referring to FIG. 6, the weight of contact member 44 is used to maintain contact. A possible drawback with this variation is that vibration may bounce the pendulum off the seat resulting in the loss of sealing contract. In FIG. 7, a threaded engagement 64 provides fine adjustment of the length of pendulum 36, and the appropriate gap between contact member 44 and bearing surface 47. A possible drawback with this variation is that wear could adversely affect the adjustment, resulting in the gap being reduced or eliminated.

In this patent document the word "comprising" is used in its non-limiting sense to mean that items following the word are included but items not specifically mentioned are not excluded. A reference to an element by the indefinite article "a" does not exclude the possibility that more than one of the element is present, unless the context clearly requires that there be one and only one of the elements.

What is claimed is:

1. An apparatus (10) for keeping a down hole drilling tool vertically aligned, comprising:

a tubular cuter housing (12) having a first end (14), a second end (16), a longitudinal axis (18) and a circumferential wall (20) that defines an interior bore (22);

centralizers (24) in spaced relation around the circumferential wall (20) at the second end (16) of the tubular housing (12), the centralizers (24) being pivotally mounted to the outer housing (12) for pivotal movement between an extended position and a retracted position;

pistons (26) positioned in piston chambers (25) which are arranged radially in relation to the longitudinal axis (18), the pistons (26) having an extended position and a refracted position, the pistons (26) underlying each of the centralizers (24) such that, in the extended position the pistons (26) provide a force to urge the centralizers (24) to the extended position;

a plurality of discrete drilling fluid chambers (30), each of the drilling fluid chambers (30) communicating with one of the piston chambers (28) of one of the pistons (26), the position of the piston (26) being controlled by a hydraulic pressure in the drilling fluid chamber (30), each of the drilling fluid chambers (30) having an inlet (32) through which drilling fluids enter and an outlet (34), the outlets for the drilling fluid chambers being arranged in an annular configuration;

a tubular pendulum (36) having a circumferential wall (38), a first end (40), and a second end (42), the first end (40) being pivotally secured within the interior bore (22) of the outer housing (12) for omni-directional pivotal movement, the pendulum (36) moving from a concentric pivotal position to an angularly offset pivotal position by force of gravity as the outer housing (12) deviates from a vertical orientation, such that, as the pendulum (36) moves between the concentric pivotal position and the angularly offset pivotal position, the pendulum (36) adjusts the hydraulic pressure in at least one drilling fluid chamber (30) by physically restricting flow of fluid in one of the concentric pivotal position or the angularly offset position and allowing the flow of fluid through the corresponding outlet (34) of the at least one drilling fluid chamber (30) in another of the concentric pivotal position or the angularly offset position, such that, as the hydraulic pressure changes, the piston (26) in communication with the at least one drilling fluid chamber (30) adjusts the position of the centralizers (24) until the outer housing (12) returns to the vertical position.

2. The apparatus as defined in claim 1, wherein a flow restrictor (39) is positioned in the inlet (32) to the drilling fluid chamber (30) to control flow.

3. The apparatus as defined in claim 1, wherein a pair of concentric metal sleeves (52) and 54) are positioned upstream of the inlet (32) to the drilling fluid chamber (30) to grind up large particles in the drilling fluid before they reach the inlet (32).

4. The apparatus as defined in claim 1, wherein the pendulum (36) restricts flow through the outlets (34) of the drilling fluid chambers (30) in the concentric pivotal position, and the pendulum (36) allows flow through at least one outlet (30) of at least one drilling fluid chamber (30) in the angularly offset pivotal position.

5. The apparatus as defined in claim 1, wherein an annular contact member (44) is mounted at the second end (42) of the pendulum (36), the annular contact member (44) is biased by biasing springs (46) into engagement with the annular configuration of outlets (34), such that the annular contact member (44) closes the outlets (30) when the pendulum (36) is in the concentric pivotal position until the biasing force of the biasing springs (46) are overcome to allow drilling fluids to bleed past.

6. The apparatus as defined in claim 1, wherein the pendulum (36) allows flow through the outlets (34) of the drilling fluid chambers (30) in the concentric pivotal position, and the pendulum (36) restricts flow through at least one outlet (34) of at least one drilling fluid chamber (30) in the angularly offset pivotal position.

7. The apparatus as defined in claim 1, wherein an annular collar (25) is provided to limit outward movement of the centralizers (24) in the extended position.

8. The apparatus as defined in claim 1, wherein axial bearings (48) are provided at the first end (40) of the pendulum (36) to withstand axial loading between the inner mandrel (11) and the outer housing (12).

9. The apparatus as defined in claim 1, wherein biasing springs (50) are provided at the first end (40) of the pendulum (36) to assist in axial adjustment during assembly.

10. The apparatus as defined in claim 1, wherein an annular contact member (44) is mounted at the second end (42) of the pendulum (36), the position of the annular contact member (44) relative to the annular configuration of outlets (34) being controlled by a threaded engagement (64).

* * * * *